US006054698A

United States Patent [19]

Mast

[11] Patent Number: 6,054,698

[45] Date of Patent: Apr. 25, 2000

[54] MICROWAVE RETAINING PACKAGE FOR MICROWAVE COOKING

[76] Inventor: Roy Lee Mast, 2200 Huntington Dr., Plano, Tex. 75075

[21] Appl. No.: 08/740,728

[22] Filed: Nov. 1, 1996

[51] Int. Cl.[7] ..... H05B 6/80

[52] U.S. Cl. ..... 219/730; 219/735; 219/729; 219/686; 426/107; 426/234; 426/243; 99/DIG. 14

[58] Field of Search ..... 219/725, 727, 219/728, 729, 730, 732, 735, 686; 426/107, 109, 113, 234, 241, 243, 118; 99/DIG. 14; 229/903; 383/204, 100, 103

[56] References Cited

U.S. PATENT DOCUMENTS

| | | |
|---|---|---|
| 2,582,174 | 1/1952 | Spencer . |
| 2,622,187 | 12/1952 | Welch . |
| 3,591,751 | 7/1971 | Goltsos . |
| 3,630,755 | 12/1971 | Schiffmann . |
| 3,699,899 | 10/1972 | Schiffmann . |
| 3,865,301 | 2/1975 | Pothier . |
| 3,934,106 | 1/1976 | MacMaster . |
| 3,941,967 | 3/1976 | Sumi . |
| 4,190,757 | 2/1980 | Turpin . |
| 4,230,924 | 10/1980 | Brastad . |
| 4,248,901 | 2/1981 | Austin . |
| 4,261,504 | 4/1981 | Cowan . |
| 4,267,420 | 5/1981 | Brastad . |
| 4,283,424 | 8/1981 | Manoski . |
| 4,351,997 | 9/1982 | Mattisson . |
| 4,361,227 | 11/1982 | Paulucci . |
| 4,411,364 | 10/1983 | Friedman . |
| 4,453,665 | 6/1984 | Roccaforte . |
| 4,518,087 | 5/1985 | Goglio . |
| 4,576,285 | 3/1986 | Goglio . |
| 4,594,492 | 6/1986 | Maroszek . |
| 4,626,641 | 12/1986 | Brown . |
| 4,640,838 | 2/1987 | Isakson . |
| 4,641,005 | 2/1987 | Seiferth . |
| 4,656,325 | 4/1987 | Keefer . |
| 4,667,453 | 5/1987 | Goglio . |
| 4,703,148 | 10/1987 | Mikulski . |
| 4,705,174 | 11/1987 | Goglio . |
| 4,705,929 | 11/1987 | Atkinson . |
| 4,786,190 | 11/1988 | Van Erden . |
| 4,794,005 | 12/1988 | Swiontek . |
| 4,841,112 | 6/1989 | Peleg . |
| 4,870,233 | 9/1989 | McDonald . |
| 4,873,101 | 10/1989 | Larson . |
| 4,877,932 | 10/1989 | Bernstein . |
| 4,882,463 | 11/1989 | Kyongoku . |
| 4,883,936 | 11/1989 | Maynard . |
| 4,890,439 | 1/1990 | Smart . |
| 4,891,482 | 1/1990 | Jaeger . |
| 4,911,938 | 3/1990 | Fisher et al. ..... 219/727 |
| 4,923,704 | 5/1990 | Levinson . |

(List continued on next page.)

*Primary Examiner*—Philip H. Leung
*Attorney, Agent, or Firm*—David W. Quimby

[57] ABSTRACT

A microwave cooking system is provided for cooking a food product in a microwave field to produce a food product with a texture and taste similar in quality to food products prepared in a conventional oven. The system utilizes a microwaveable tray comprising a microwave susceptor material laminated to a thin paperboard sheet for supporting and heating a food product to be cooked thereon. A single sheet corrugated plate is attached to a lower surface of the microwaveable tray in order to provide space beneath the microwaveable tray for the circulation of heated air. The tray containing the food product thereon is sealed in a polymer bag having microwave shielding material on the inner surface of the upper side of the sealed polymer bag for minimizing the amount of direct microwave transmission contacting the food product contained therein. The sealed polymer bag has a pressure regulation port for releasing and maintaining pressure which builds inside the sealed polymer bag during cooking. The sealed polymer bag utilizes an internally positioned tear strip tape which terminates at an externally positioned tear tab for opening the sealed polymer bag at the conclusion of cooking operations. During cooking, the food product contained in the microwave cooking system is cooked in a high pressure, high heat environment through a combination of conduction, convection and microwave excitation cooking.

17 Claims, 5 Drawing Sheets

U.S. PATENT DOCUMENTS

| | | | |
|---|---|---|---|
| 4,925,684 | 5/1990 | Simon . | |
| 4,940,867 | 7/1990 | Peleg . | |
| 4,944,409 | 7/1990 | Busche . | |
| 4,960,598 | 10/1990 | Swiontek . | |
| 4,973,810 | 11/1990 | Brauner | 219/727 |
| 4,985,300 | 1/1991 | Huang | 426/392 |
| 5,003,142 | 3/1991 | Fuller . | |
| 5,041,295 | 8/1991 | Perry . | |
| 5,041,325 | 8/1991 | Larson . | |
| 5,045,330 | 9/1991 | Pawlowski . | |
| 5,053,594 | 10/1991 | Thota . | |
| 5,061,500 | 10/1991 | Mendenhall . | |
| 5,075,526 | 12/1991 | Sklenak . | |
| 5,077,455 | 12/1991 | Peleg . | |
| 5,079,059 | 1/1992 | Wyslotsky . | |
| 5,126,519 | 6/1992 | Peleg . | |
| 5,153,402 | 10/1992 | Quick . | |
| 5,171,950 | 12/1992 | Brauner . | |
| 5,195,829 | 3/1993 | Watkins . | |
| 5,229,563 | 7/1993 | Isogai . | |
| 5,247,149 | 9/1993 | Peleg . | |
| 5,252,793 | 10/1993 | Woods . | |
| 5,287,961 | 2/1994 | Herran . | |
| 5,298,708 | 3/1994 | Babu . | |
| 5,300,746 | 4/1994 | Walters . | |
| 5,412,187 | 5/1995 | Walters . | |
| 5,416,305 | 5/1995 | Tambellini . | |
| 5,464,969 | 11/1995 | Miller . | |
| 5,484,984 | 1/1996 | Gics . | |
| 5,530,231 | 6/1996 | Walters . | |
| 5,543,606 | 8/1996 | Gics . | |

MICROWAVE RETAINING PACKAGE FOR MICROWAVE COOKING

FIELD OF THE INVENTION

This invention relates in general to cooking by means of microwave energy, and more particularly relates to a system utilizing a tray or panel covered with microwave susceptor material for supporting and cooking a food product placed in a sealed polymer bag which provides microwave shielding and which regulates and maintains an elevated internal heat and pressure during the microwave cooking process.

BACKGROUND OF THE INVENTION

The use of microwave energy for cooking has been available for many years. However, many foods are considered to be "non-microwaveable foods." Such foods share the characteristic that microwave energy does not evenly heat the food item, or else the microwave energy produces an undesirable food texture. Examples of food typically considered to be non-microwaveable are bread and pizza dough. Bread products are typically non-microwaveable because microwaving of bread products causes a phenomenon known as cross-linking of starches and proteins which leads to cellular breakdown in the starches, and ultimately leads to an undesirable texture. In addition to the undesirable texture found in microwaved bread products, microwave cooking of bread products tends to drive out moisture and heat the bread product in an uneven manner.

It is known in the art to use microwave transparent materials as cooking vessels for use in a microwave oven. It is also known to use microwave shielding material to shield microwave energy from a food product or to focus microwave energy to a particular portion of a food product. It is also known to use microwave susceptor materials in microwave cooking apparatuses for directly heating food and browning by conduction from microwave susceptor material heated by absorption of microwaves.

The self-venting microwaveable package disclosed in U.S. Pat. No. 5,464,969 is a microwaveable plastic bag for heating a variety of products including liquids. One seam of the bag incorporates a strip seal that vents when enough pressure is generated in the bag, to prevent explosion.

An appliance for cooking a frozen pizza pie with microwave energy is disclosed in U.S. Pat. No. 5,247,149. A tray for supporting and cooking a frozen pizza pie is octagonal in shape, and the upper surface of the tray carries a microwave susceptor material. The tray has side tabs which also carry microwave susceptor material and which fold over the edge crust and contact the dough of the frozen pizza.

A multi-layer microwave conductive structure is disclosed in U.S. Pat. No. 5,530,231, which is incorporated herein by reference. A conductive structure for use in microwave food packaging is disclosed that adapts itself to heat food articles in a safer, more uniform manner is disclosed. The structure includes a conductive layer disposed on a non-conductive substrate. Provision in the structure's conductive layer of links and base areas causes microwave induced current to be channeled through the links resulting in controlled heating.

Metallized microwave diffuser films are disclosed in U.S. Pat. No. 5,300,746 which is incorporated herein by reference. The films include an insulative substrate having a first side upon which is deposited a metallic coating capable of selectively reflecting a portion of incoming microwave energy.

Those systems, which disclose vessels for heating or cooking using microwave energy or disclose materials which reflect microwave energy or become hot upon contact with microwave energy transmission, may be used to heat and cook food products adequately, but are ineffective in cooking bread products, such as uncooked pizza dough, which include starch components in the basic structural make-up of the food product. As discussed above, bread products cooked by microwave energy typically exhibit an undesirable texture due to cellular break down of the starch components contained therein.

Therefore, there is a need in the art for a microwave cooking package system which may be used to cook a fresh, frozen, or refrigerated cooked or uncooked dough product in a microwave oven with the resulting bread having the texture and taste of bread cooked in a conventional oven.

SUMMARY OF THE INVENTION

The present invention provides a microwave cooking package which may be used to cook fresh, frozen, refrigerated dough products such as pizza, bread, cookies, pastries, etc. The dough products may be pre-cooked or uncooked. The present invention may be used to cook a variety of other food items which normally are not satisfactorily cooked using microwave cooking. The present invention employs a unique microwave cooking package which allows dough products to be cooked in a microwave cooking apparatus, but provides a taste and texture similar to that achieved when using a conventional oven.

Generally described, one aspect of the present invention provides an apparatus for packaging and cooking a food item using microwaves, comprising an interior panel positioned to receive a food item, where the panel is a microwave absorbing panel capable of becoming hot on exposure to microwaves, and a flexible pouch enclosing the interior panel, the pouch being capable of retaining gases at above atmospheric pressure. The pouch includes a microwave shield extending over an upper portion of the pouch above the interior panel and a lower portion transparent to microwaves. The microwave shield may be semi-permeable to microwave energy or impermeable to microwave energy. When the apparatus is exposed to microwaves, the food item is cooked by a combination of heat from the microwave absorbing floor panel, heat from high pressure steam created and retained within the pouch, and limited microwave energy absorbed by the food item.

Preferably, the interior panel is removable from the pouch and includes means for spacing the panel above the lower portion of the pouch. The interior panel may include a plurality of side walls foldably connected to and perpendicular to the floor panel. The pouch, prior to exposing the apparatus to microwaves, holds the side walls of the interior panel in the perpendicular position.

The pouch preferably comprises a polymer film and means for venting the pouch at a desired interior pressure. The means for venting the pouch at a desired interior pressure may include means for maintaining the interior pressure of said pouch at a desired level and means for opening said pouch. The means for opening the pouch may comprise a tear strip disposed interior of the pouch, the tear strip running from a first end of the pouch to a second end of the pouch. A tear tab may be disposed along the first end of the pouch and be operatively connected to the tear strip.

Another aspect of the present invention provides an apparatus for cooking a food item using microwave energy, comprising a flexible pouch including a microwave shield extending over an upper portion of the pouch above a lower portion of the pouch which is transparent to said microwave energy, and means for providing tension across the upper portion of the pouch for preventing failure of the microwave shield.

Another aspect of the present invention provides a method of cooking a food item using microwave energy comprising the steps of placing the food item on a microwave absorbing panel capable of becoming hot upon exposure to microwave energy and sealing the panel containing the food item in a flexible pouch having a microwave shield for limiting exposure of the food item to microwave energy during cooking. The method also comprises the steps of exposing the pouch to microwave energy, shielding the food item such that a reduced portion of the microwave energy received by the pouch is received by the food item, heating the microwave absorbing panel by exposure to microwave energy, raising the temperature within the pouch to between about 250 and 450 degrees Fahrenheit, raising the internal pressure of the pouch to above atmospheric pressure, and venting the pouch to maintain the pressure at a desired level and to release steam from the interior of the pouch. The method may comprise the step of browning the exterior surface of the food item which is in contact with the microwave absorbing panel. And, the method may include the steps of providing an air passageway under the panel, and circulating heated and pressurized air under the tray. The method may also comprise the steps of driving heated moisture out of the food item into the interior of the pouch; and bathing the food item in the heated moisture for providing even cooking of the food item.

Another aspect of the present invention provides an apparatus for packaging and cooking a food item using microwaves, comprising an enclosure having an upper portion and a lower portion, the enclosure capable of retaining gases at above atmospheric pressure, and the enclosure having means for regulating the pressure of the gases retained by the enclosure. A microwave susceptor surface is positioned along the lower portion of the enclosure for receiving the food item. The enclosure includes a microwave shield extending over the upper portion of the enclosure above the susceptor surface, the lower portion being transparent to microwaves. When the apparatus is exposed to microwaves, the food item is cooked by a combination of heat from the microwave absorbing floor panel, heat from high pressure steam created and retained within the enclosure, and limited microwave energy absorbed by the food item. The means for regulating the pressure of said gases retained by said enclosure may comprise a pressure regulation port.

Thus it is an object of the present invention to provide an improved microwave packaging and cooking package and method.

It is a further object of the present invention to provide a microwave cooking package and method which cooks a dough product at high temperatures and high pressure.

It is a further object of the present invention to provide a microwave cooking package and method which cooks a dough product with a taste and texture similar to that produced in a conventional oven.

Other objects, features, and advantages of the present invention will become apparent upon review of the following description of the preferred embodiments and the appended drawings and claims.

DETAILED DESCRIPTION

Figure 1:
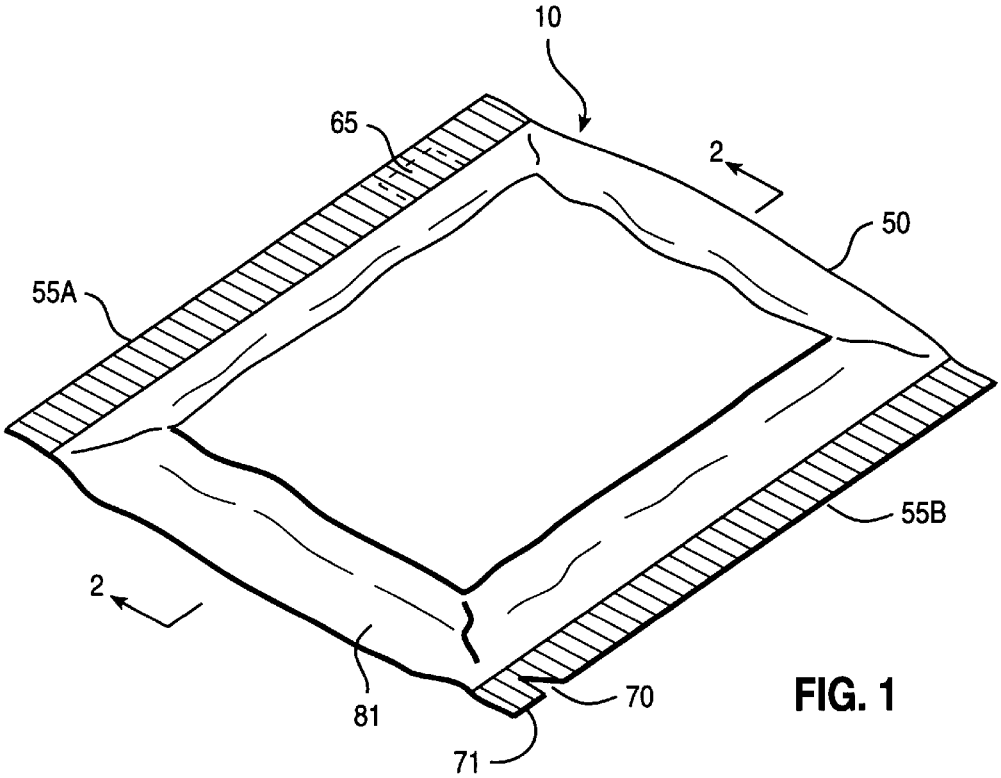
FIG. 1 is a pictorial view of a microwave cooking package embodying the present invention.

Referring now in more detail to the drawings, in which like numerals refer to like parts throughout several views, FIG. 1 shows a microwave cooking system 10 embodying the present invention. With reference to FIGS. 1–4, the microwave cooking apparatus 10 includes a sealed polymer bag 50 having a microwave shield material 80 laminated to the interior of a top portion of the sealed polymer bag 50. The sealed polymer bag 50 includes a pressure regulation port 65 for regulating internal pressure during cooking operations. A tray 150 for supporting heating, and browning a food item 200 to be cooked in the microwave cooking system 10 is provided and includes a microwave susceptor material 160 and a corrugated base layer 170 for elevating the tray 150. The tray 150 supporting the food 200 is sealed inside the sealed polymer bag 50 during manufacturing. The subassemblies thus far noted will now be described in detail.

Figure 4:
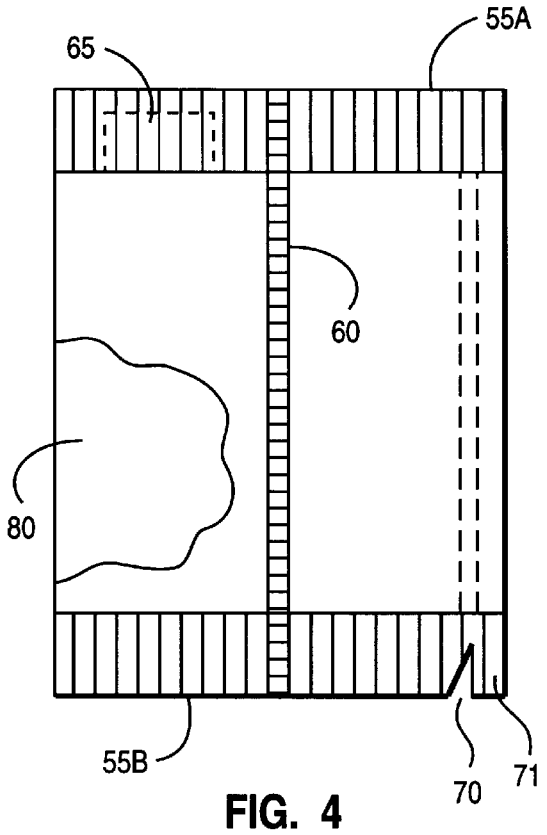
FIG. 4 is a bottom plan view of the sealed polymer bag of FIG. 3 with a portion cut away to expose the interior of the sealed polymer bag showing microwave shielding material on the interior upper surface of the sealed polymer bag.
Figure 6:
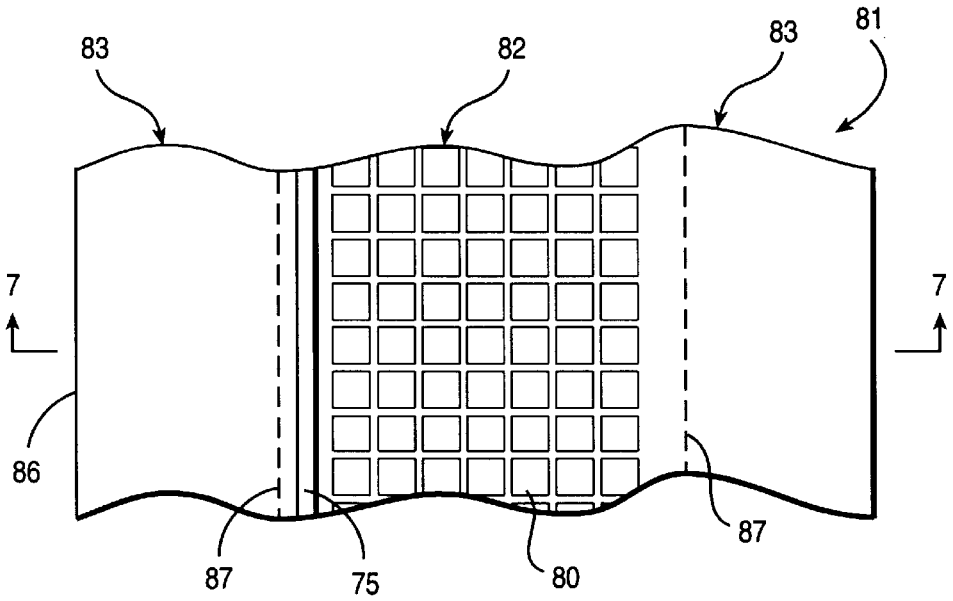
FIG. 6 is a diagrammatic view of a continuous polymer film including microwave shielding material and a tear strip tape.

The sealed polymer bag 50 preferably is formed from a continuous sheet of multi-layer film 81 that is divided longitudinally into a center panel 82 and a pair of side panels 83 defined by fold lines 87, as shown in FIG. 6. A tube-like structure (not shown) is formed by folding the side panels about the parallel fold lines 87 such that exposed side edges 85 and 86 of the side panels are brought together at approximately the middle of the center panel and are sealed using conventional heat and pressure sealing means which are well known in the art. As shown in FIG. 4, edges 85 and 86 are sealed together to form a seam 60 which will be located, after further processing described below, on the underside of the sealed polymer bag 50.

Figure 3:
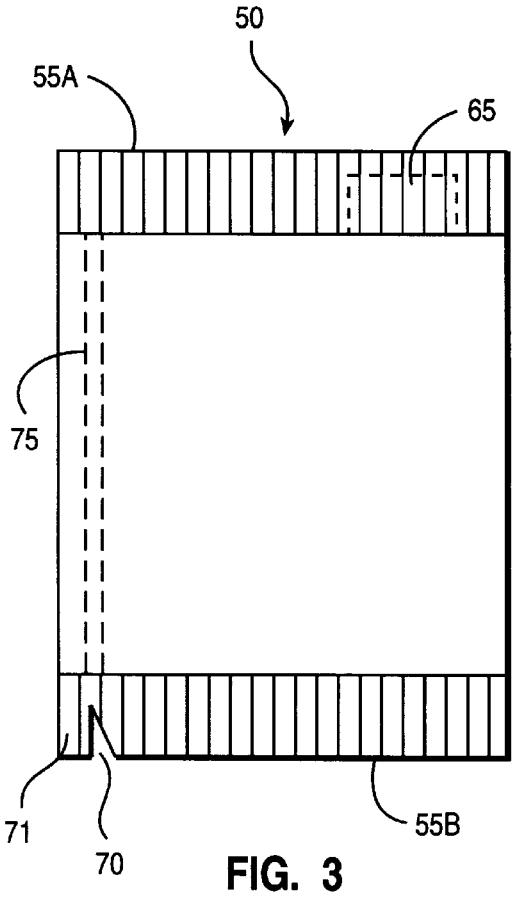
FIG. 3 is a top plan view of a sealed polymer bag showing a pressure regulation port and a tear strip tape in phantom.

As shown in FIGS. 3 and 4, individual sealed polymer bags 50 are fabricated from the tube-like structure by forming ribbed crimped bag closures 55A and 55B at opposite ends of the sealed polymer bag 50. The process of forming the crimped bag closures 55A and 55B is well known to those skilled in the art. A crimping apparatus simultaneously forms the trailing crimped bag closure 55 of a preceding sealed polymer bag 50 and the leading crimped bag closure 55A of the next succeeding sealed polymer bag 50, and separates the two sealed polymer bags 50 thus formed. The crimped bag closures 55A and 55B need not form "hermetic" seals, but must be sufficiently air tight to maintain pressure developed inside the sealed polymer bag 50 during cooking as discussed below, and to prevent the product from becoming stale while stored prior to cooking.

Figure 5:
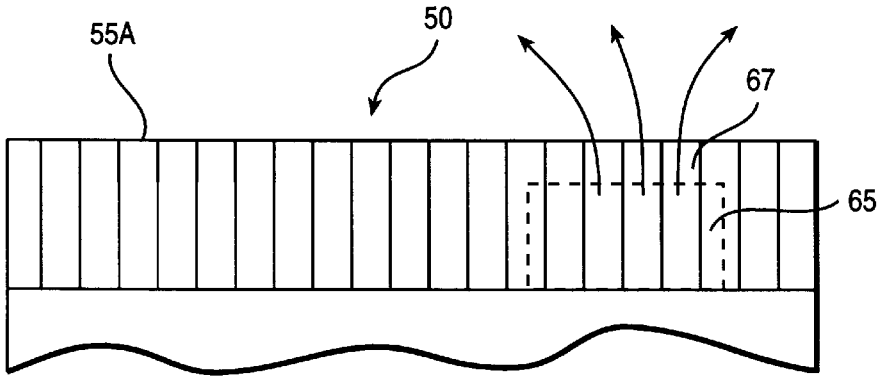
FIG. 5 is a diagrammatic view of a crimped edge of a bag enclosure showing a pressure release vent in phantom.

Referring now to FIGS. 3, 4 and 5, a pressure regulation port 65 is formed internally of the crimped bag closure 55A. The pressure regulation port 65 opens to relieve the internal pressure of the sealed polymer bag 50 during cooking operations. As described above, the crimped bag closures 55A and 55B are formed using conventional and well known crimping processes. During the crimping process utilized to form crimped bag closures 55A and 55B, a crimping tool is brought to bear on the exterior surface of the sealed polymer bag 50 in order to form the crimped bag closures 55A and 55B. The crimping tool utilized to form the crimped bag closures 55A and 55B is specially designed to leave a slightly weakened area in the crimped bag closure 55A which forms the pressure regulation port 65. The weakened area preferably extends about one inch into the closure 55A from the polymer bag. The area should be weakened to open at a pressure that will vary depending on the particular food to be cooked. Those skilled in the art can readily alter the crimping tool to adjust the opening pressure.

Referring now to FIG. 5, during cooking, pressure builds internally of the sealed polymer bag 50. When the pressure reaches a certain level, the crimped area of the regulation port 65 and the crimped area 67 adjacent to regulation port 65 rupture to allow a release of pressure, steam, and heated gases from the interior of the sealed polymer bag 50. Preferably, once the pressure regulation port 65 opens, as described, the pressure regulation port 65 remains in an open configuration and maintains the interior pressure of the sealed polymer bag 50 at or near the pressure achieved just prior to the opening of the pressure regulation port 65. This can be achieved because the food can be selected to produce steam as fast as it is released through the port.

Referring now to FIGS. 3 and 4, a tear notch 70 and a tear tab 71 are provided in the crimped bag closure 55B opposite the crimped bag closure 55A. As shown in FIGS. 3 and 6, a tear strip tape 75 is provided interior of the sealed bag 50 which runs the length of the sealed polymer bag 50 and terminates at the tear tab 71. As shown in FIG. 6 the tear strip tape 75 is provided in continuous form and is attached to the continuous composite film 81 from which the sealed polymer bag 50 is constructed. Use of a tear strip tape 75 is well known to those skilled in the art and provides for a means of easily opening the sealed polymer bag 50 and helps to isolate the user from escaping steam and heat when the sealed polymer bag 50 is opened. As is well known to those skilled in the art, the tear notch 70 and the tear tab 71 are formed in the crimped bag closure 55B by conventional means during the crimping process described above.

Figure 7:
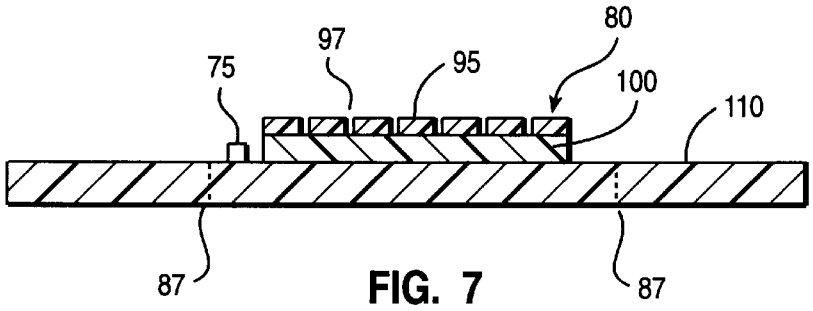
FIG. 7 is an exploded cross-sectional view of the continuous polymer film of FIG. 6, taken along line 7—7 of FIG. 6.

As noted above, the sealed polymer bag 50 is constructed from a composite film 81 which includes a layer of microwave shield material 80. As shown in FIG. 6, a microwave shield material 80 is laminated to the center panel 82 of the continuous composite film 81 to provide microwave shielding for the inside upper surface of the sealed polymer bag 50, as shown in FIG. 4. The microwave shield material 80 is laminated to the inside upper surface of the sealed polymer bag 50 and is not laminated to the bottom surface of the sealed polymer bag 50. This configuration minimizes the amount of microwave transmission through the upper surface of the sealed polymer bag 50, but allows for sufficient heating of a susceptor material laminated to the tray 150, which will be discussed in detail below. Those skilled in the art will understand that the shielding material may be distributed in any configuration so long as non-metallized transmission areas are configured so as to allow sufficient heating of the susceptor material, while not over cooking the food item as will be discussed below. As shown in FIGS. 6 and 7, the shield material includes isolated areas of metallization 95 deposited on a 48 gauge polyester film 100, separated by non-metallized lines 97. The polyester film 100 with deposited metallized areas is laminated to the cellophane film 110 with a thickness preferably on the order of 0.001 inches. The shielded portion of the sealed polymer bag 50 is formed with very small non-metallized lines 97, preferably in a square grid pattern, as shown in FIG. 6. As is well known to those skilled in the art, a variety of other patterns may be utilized. Preferably, in the present invention the shield material attenuates microwave energy passing through the upper portion of the sealed polymer bag 50 serves to spread microwave transmission more evenly within the sealed polymer bag 50, and minimizes contact of microwave energy with the food item 200. Suitable metallized microwave shielding materials are disclosed in U.S. Pat. No. 5,300,746, which is incorporated herein by reference.

As shown in FIGS. 4 and 6, the bottom side of the sealed polymer bag 50 preferably consists of non-metallized polymer film. In the preferred embodiment of the present invention, the sealed polymer bag 50 is formed by folding the continuous polymer film 110 generally about fold lines 87, as described in detail above. In order to prevent the well known phenomenon of arcing between the metallized areas of the microwave shielding during the use of the sealed polymer bag 50 in a microwave cooking oven, the fold lines 87 are preferably positioned such that the microwave shielding area is not folded. This avoids creating areas in which microwave shielding is folded onto itself in face to face spaced apart relation. In the preferred embodiment of the present invention, the microwave shielding material 80 works optimally if tension is maintained across the polymer sheet 110 on which the microwave shielding material is laminated. In the preferred embodiment, proper tension is provided by internal pressure in the sealed polymer bag 50 during cooking.

Figure 8:
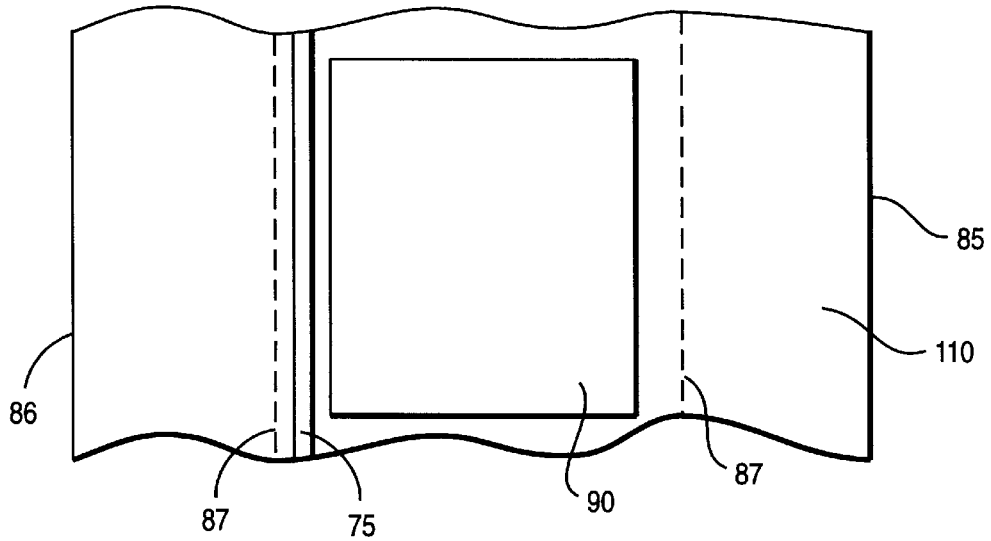
FIG. 8 is a diagrammatic view of a continuous polymer film containing an alternate solid foil microwave shielding material.

As shown in FIG. 8, an alternate form of microwave shielding may be provided which includes a solid foil shielding material 90 laminated to a continuous polymer film 110. In the alternate form shown in FIG. 8, the solid foil shielding material 90 is laminated to the continuous polymer film 110 in elongate patches with transverse gaps for the formation of the crimped closures 55A and 55B, so that the solid full shielding material 90 does not form a portion of the crimped bag closures 55A and 55B.

Figure 9:
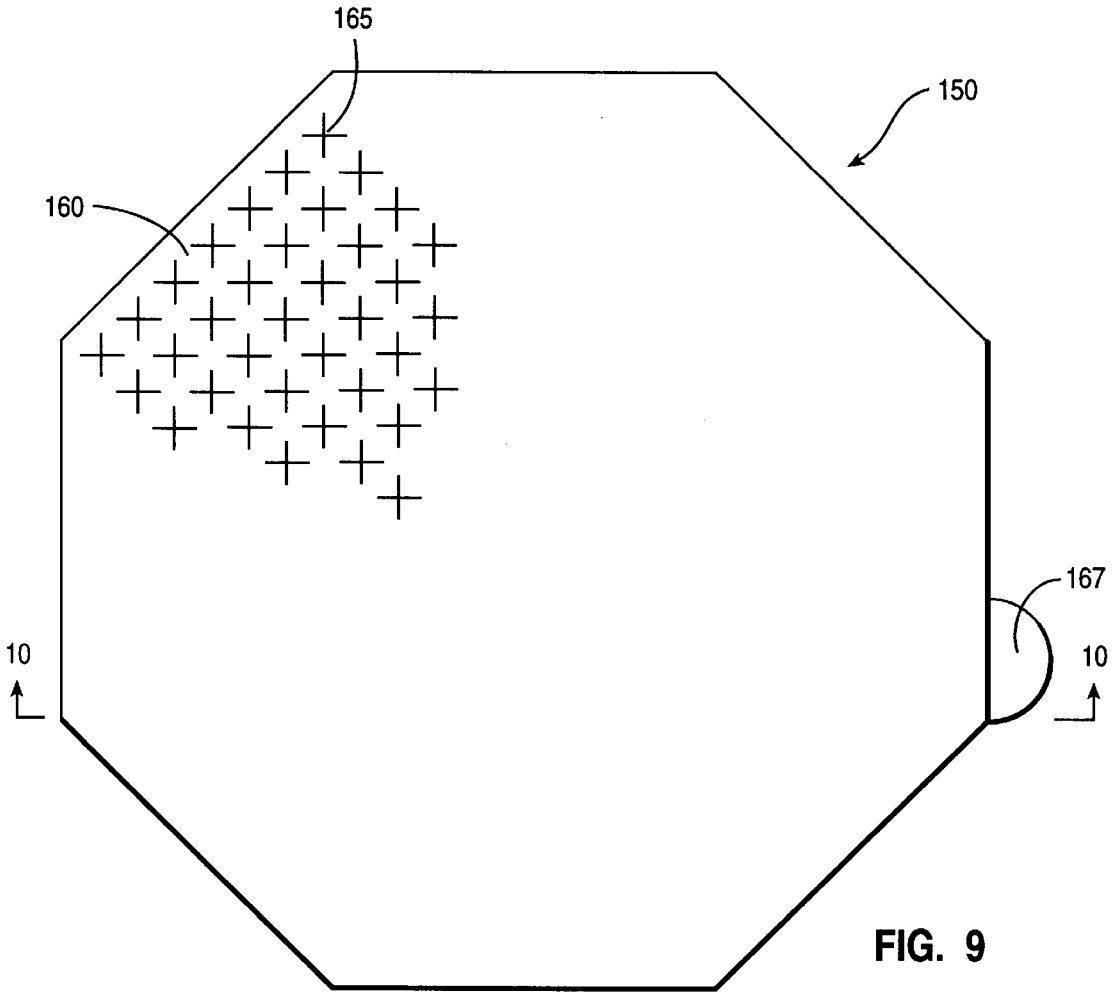
FIG. 9 is a top plan view of a cooking tray embodying the present invention showing microwave susceptor material and a pull tab.
Figure 10:
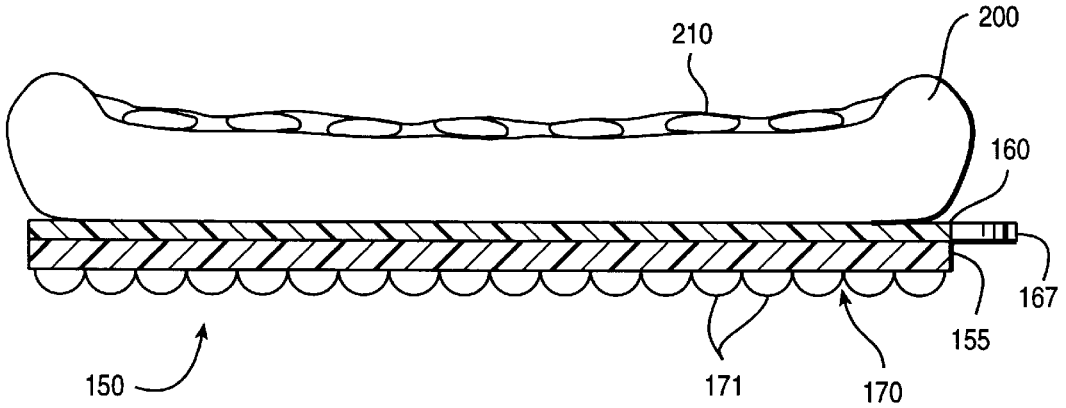
FIG. 10 is a side elevation cross-sectional view of the cooking tray of FIG. 9 taken along line 10—10 of FIG. 9.

Referring now to FIGS. 9 and 10, a panel or tray 150 is provided for supporting food item 200 to be prepared in the microwave cooking package 10. As shown in FIG. 10, the tray 150 consists of a microwave susceptor material 160 laminated to the upper surface of a thin paperboard sheet 155. In the preferred embodiment shown in FIG. 10, the thin paperboard sheet 155 overlays and is attached to a single corrugated base plate 170. The flutes 171 of the corrugated base plate 170 extend downwardly, as shown in FIG. 10, to elevate the tray 150 from the bottom of the sealed polymer bag 50 during cooking operations. Preferably the corrugated material has one liner 172 that is attached using an adhesive to the paperboard sheet 155. The corrugated base plate 170 functions to allow circulation of hot air underneath the tray, acts as a thermal transfer device, and helps to retain heat generated during the cooking process. The corrugated base plate 170 also absorbs condensation that may be created within the sealed polymer bag 50 during cooling. As shown in FIG. 9, a pull tab 167 is provided to assist the user in extracting the tray containing the food 200 from the sealed polymer bag 50 after cooking operations are complete.

Referring still to FIGS. 9 and 10, the microwave susceptor material 160 laminated to the upper surface of the thin paperboard sheet 155 is not a continuous metallized layer like some microwave susceptor materials known in the art. As is well known to those skilled in the art, microwave susceptor materials, such as described herein, become hot when subjected to microwave energy transmission. As used in the present invention, such microwave susceptor materials provide an even heating surface and provide a surface which can brown and crisp food, while producing heat by conduction to assist in cooking the food. The microwave susceptor material 160 utilized in the present invention is preferably interrupted by a pattern of small crosses 165 which serve to quench overheating of the microwave susceptor material by fusing heat and energy between the small crosses 165 if overheating occurs. The susceptor material described herein is described in U.S. Pat. No. 5,530,231 which is incorporated herein by reference.

Figure 11:
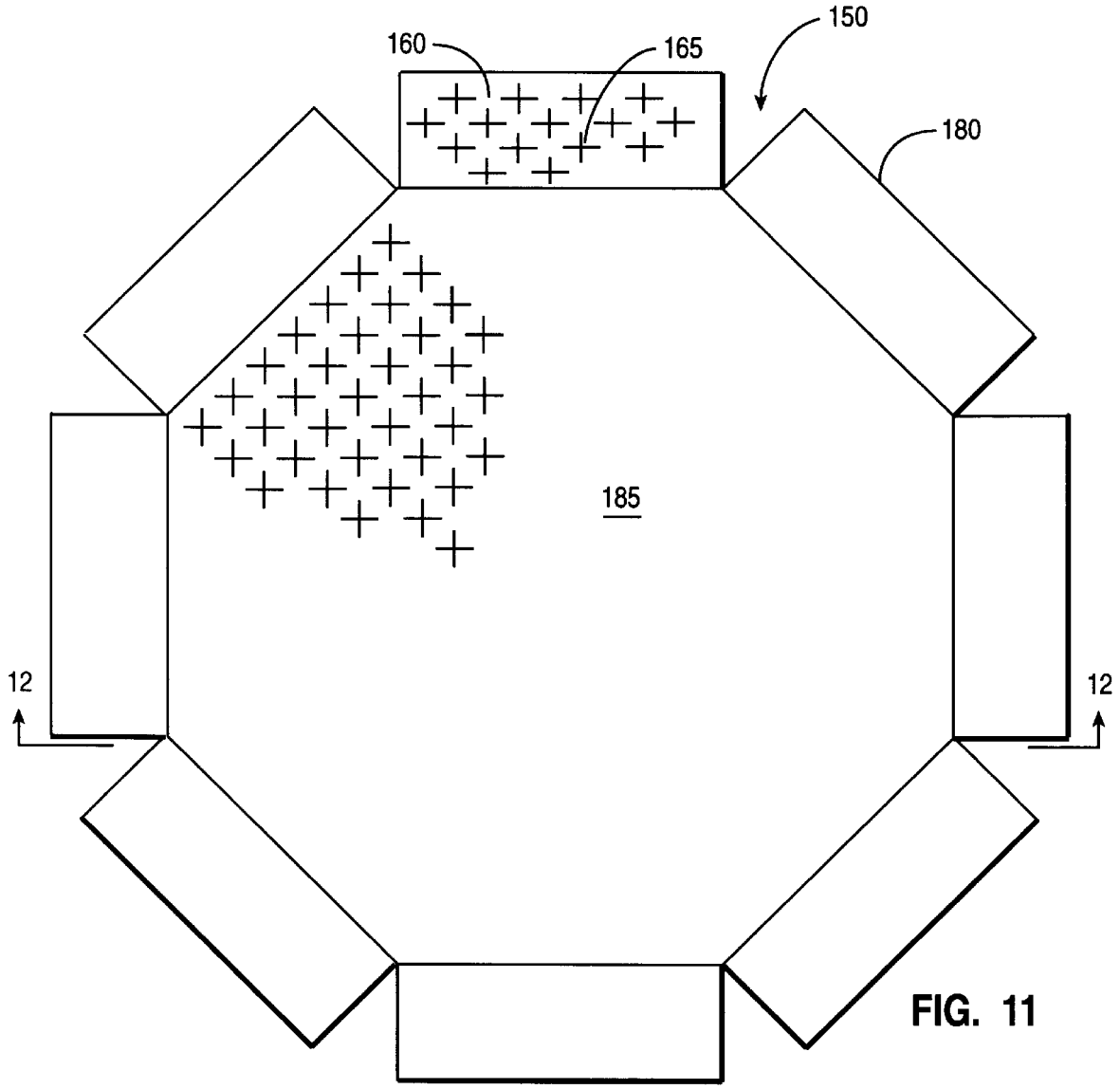
FIG. 11 is a top plan view of an alternate cooking tray showing microwave susceptor material and side tabs.
Figure 12:
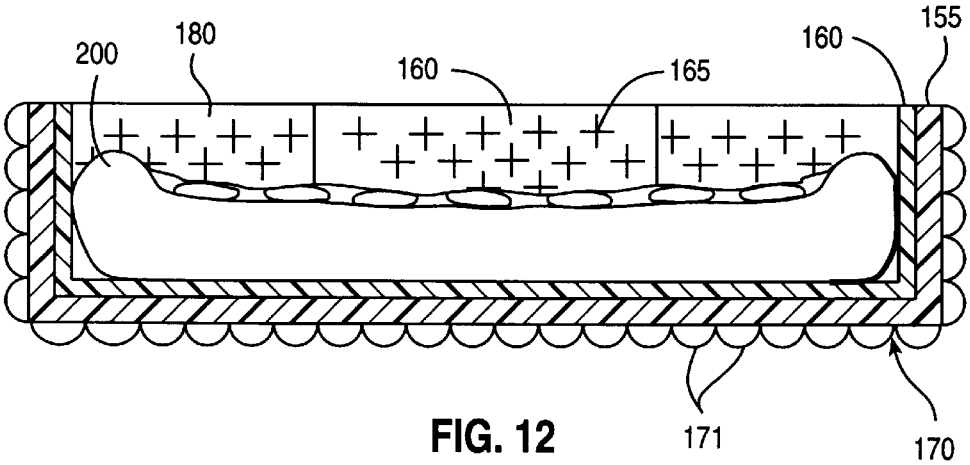
FIG. 12 is a side elevation cross-sectional view of an assembled cooking tray of FIG. 11 cut along line 12—12 of FIG. 11 and showing a cross-sectional view of an uncooked pizza dough supported thereon.

Referring now to FIGS. 11 and 12, an alternate form of the tray 175 is provided. The alternate form of the tray 175 shown in FIG. 11 includes a plurality of tabs 180, which when erected to an angle above the horizontal, preferably a 90° angle with the base 185 of the alternate tray 175, forms side walls. The side wall tabs, as well as the central portion of the tray, are laminated with susceptor material. This alternate construction of the tray 175 is useful in situations where it is desired that the outer sides of the food item 200 be in contact with microwave susceptor material, as shown in FIG. 12.

Operation

Figure 2:
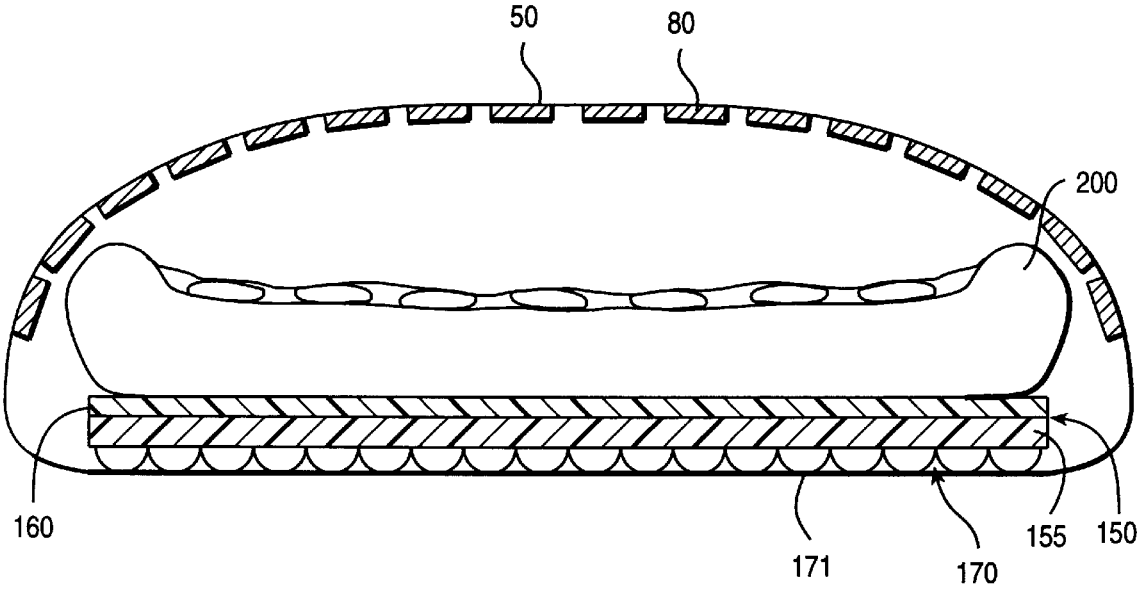
FIG. 2 is a cross-sectional view of the microwave cooking package of FIG. 1 taken along line Z—Z of FIG. 1 and showing the contents thereof.

In use, a food item 200, such as a frozen, refrigerated, pre-cooked or uncooked pizza, uncooked bread or cookie dough, is placed on the tray 150 or 175 as shown in FIGS. 2, 10 and 12. The tray 150 or 175 becomes positioned in the sealed polymer bag 50 during the manufacturing of the sealed polymer bag 50. In the bag forming process described in detail above, the sealed polymer bag 50 is formed and sealed around the tray containing the food item 200 by forming the bottom seam 60 below the tray, and then forming the crimped bag closures 55A and 55B as shown in FIGS. 3 and 4 between adjacent trays.

The microwave cooking package 10 containing the food item 200 and formed, as described above, may be placed in protective packaging, and shipped to regular marketing outlets such as grocery stores, convenience stores, etc. where it is then purchased for use by individual consumers. The microwave cooking package 10 comprised of the sealed polymer bag 50 containing the tray 150 and food item 200 is placed in a microwave cooking apparatus such as any standard microwave oven available on the market and is subjected to microwave cooking for a prescribed period of time. As the microwave cooking package 10 is subjected to microwave energy transmission, the temperature of the microwave susceptor material 160 on the upper surface of the tray 150 increases dramatically. Heat from the susceptor material also radiates downwardly to heat air circulating within the flutes 171 of the corrugated base plate 170. The temperature of the food item 200 rises dramatically as a result of heat energy conductively transferred from the underlying microwave susceptor material, heat energy convectively transferred from circulating hot air and steam, and by molecular excitation of the food item 200 by microwave energy.

The food item 200 typically contains moisture, as is the case in bread doughs. As the heat inside the sealed polymer bag 50 rises dramatically as described, the moisture within the food item is converted into steam and the pressure inside the sealed polymer bag 50 rises correspondingly. As is well known to those skilled in the art, as the pressure inside the sealed polymer bag 50 rises, the temperature of vapors inside the sealed polymer bag 50 also rises. The presence of the hot, high pressure vapors inside the sealed polymer bag 50 aids in cooking the food item 200 more evenly and more quickly as the food item 200 is bathed in the steam and as the steam penetrates back into the food.

As the pressure of the heated vapors inside the sealed polymer bag 50 rises to a certain level, the pressure regulation port 65 opens, as described in detail above, to prevent the internal pressure of the sealed polymer bag from becoming excessive. At the same time, the pressure regulation port 65 maintains the internal pressure of the sealed polymer bag at a desired level. Accordingly, the build up and maintenance of pressure inside the sealed polymer bag 50 allows the sealed polymer bag 50 to act as a pressure cooker, allowing higher temperatures to be reached around the food item 200 so that the food item 200 is evenly and quickly baked.

Example

An uncooked personal pizza, having pizza dough with a diameter of approximately five inches and thickness of approximately one-half inch and having toppings consisting of pizza sauce and cheese, is placed on the upper surface of a tray 150 as shown in FIGS. 9 and 10. The tray 150 containing the pizza (food item) 200 is sealed inside a sealed polymer bag 50 by producing crimped bag closures 55A and 55B. A pressure regulation port 65 and a tear notch 70 are simultaneously produced.

The resulting microwave cooking package 10 is placed in a 500 watt microwave oven and cooked for three minutes on a microwave energy setting of high. At approximately one minute into a three minute cooking cycle, the pressure regulation port 65 opens to release pressure building in the interior of the sealed polymer bag 50 and maintains a desired pressure throughout the duration of the cooking cycle. At one minute into the three minute cooking cycle, the temperature of the microwave susceptor material on the upper surface of the tray 150 is approximately 375° F. and the ambient temperature inside the sealed polymer bag is approximately 425° to 450° F.

At the conclusion of the three minute cooking cycle, the microwave cooking package 10 is extracted from the microwave oven. The sealed polymer bag 50 is opened by engaging the tab 71 formed by the tear notch 70 and tearing open the sealed polymer bag 50 by pulling the tab 71 in a direction opposite the crimped bag closure 55B along the line formed by tear strip tape 75. As the sealed polymer bag 50 is opened, as described, hot air and steam is released from the sealed polymer bag 50. The tray 150 containing the pizza 200 is removed from the opened sealed polymer bag 50 by engaging pull tab 167 and extracting the tray 150 from the sealed polymer bag 150.

The dough of the pizza 200 is found to be evenly cooked and lightly browned on the exterior surfaces. The toppings of the pizza 200 are evenly cooked and the cheese is melted. The pizza 200 is consumed and is found to have a surprisingly good taste and texture.

While the present invention and its various aspects have been described in detail with regard to preferred embodiments thereof, it should be understood that variations, modifications and enhancements can be made to the disclosed apparatus and procedures without departing from the spirit and scope of the present invention as defined in the appended claims.

What is claimed is:

1. A package for cooking a food item using microwaves comprising:

a sealed flexible pouch which retains hot gases above atmospheric pressure within the pouch to heat and cook the food item when the package is exposed to microwave energy;

a mechanically formed weakness in a seal of the pouch which ruptures and vents the pouch when interior pressure within the pouch due to hot gases exceeds a desired pressure; and a panel positioned within the pouch, said panel having a bottom and a wall, said panel capable of absorbing microwaves and capable of becoming hot on exposure to microwaves, said bottom of the panel supporting the food item within the pouch; wherein when said package is exposed to microwaves, said food item cooks by a combination of heat from said panel, microwave energy absorbed by said food item, and heat from gases retained within said pouch.

2. The package for cooking a food item using microwaves as defined in claim 1 wherein said panel is removable from said pouch.

3. The package for cooking a food item using microwaves as defined in claim 1 further comprising a microwave shield positioned over said food item.

4. The package for cooking a food item using microwaves as defined in claim 3 further comprising tension means across an upper portion of said pouch for preventing failure of said microwave shield.

5. The package for cooking a food item using microwaves as defined in claim 4 wherein said tension means is said wall of the panel.

6. The package for cooking a food item using mocrowaves as defined in claim 4 wherein said tension means is interior pressure within the pouch.

7. The package for cooking a food item using microwaves as defined in claim 3 wherein said microwave shield is semi-permeable to microwave energy.

8. The package for cooking a food item using microwaves as defined in claim 3 wherein said microwave shield is impermeable to microwave energy.

9. The package for cooking a food item using microwaves as defined in claim 1 further comprising a tear strip in working relation to said pouch, said tear strip having a gripping tab at an end of the tear strip.

10. A package for cooking a food item using microwaves comprising:

a sealed enclosure having a bottom, a top, and walls, said enclosure retains hot gases and steam at above atmospheric pressure within the enclosure to heat and cook the food item when the package is exposed to microwave energy, said bottom of the enclosure supports the food item within the enclosure;

a weakness in a seal of the enclosure which ruptures and vents the enclosure when interior pressure within the enclosure exceeds a desired pressure; and microwave susceptor surfaces on the bottom and on a wall of the enclosure, said microwave susceptor surfaces absorb microwave energy and become hot upon exposure to microwave energy; wherein when said package is exposed to microwaves, said food item cooks by a combination of heat from the susceptor surfaces, microwave energy absorbed by the food item, and heat from steam created and retained within the enclosure.

11. The package for cooking a food item using microwaves as defined in claim 10 further comprising a microwave shield positioned over said food item.

12. The package for cooking a food item using microwaves as defined in claim 11 wherein said microwave shield is semi-permeable to microwave energy.

13. The package for cooking a food item using microwaves as defined in claim 11 wherein said microwave shield is impermeable to microwave energy.

14. A method of cooking a food item using microwave energy comprising:

placing the food item on a panel, said panel having a microwave absorbing surface which becomes hot upon exposure to microwave energy;

sealing said panel and food item in a package, wherein a seal of the package has a weakness that ruptures when internal pressure within the package exceeds a desired pressure;

exposing the package to microwave energy;

cooking the food item with heat generated by the absorption of microwave energy by said microwave absorbing surface of the panel;

cooking the food item with microwave energy absorbed by the food item;

cooking the food item with steam and hot gases generated by heating of the food item, said steam and hot gases retained within the package; and rupturing the package at the weakness in the seal when the internal pressure of the package exceeds the desired pressure to allow for release of excess pressure;

venting some steam and hot gases through the rupture; and retaining some steam and hot gases within the package after rupturing the package to heat and cook the food item.

15. The method of cooking a food item using microwave energy as defined in claim 14 further comprising:

placing a microwave shield over the food item prior to exposing the package to microwave energy.

16. The method of cooking a food item using microwave energy as defined in claim 15 wherein said microwave shield is semi-permeable to microwave energy.

17. The method of cooking a food item using microwave energy as defined in claim 15 wherein said microwave shield is impermeable to microwave energy.

* * * * *

UNITED STATES PATENT AND TRADEMARK OFFICE

CERTIFICATE OF CORRECTION

PATENT NO : 6,054,698

DATED : April 25, 2000

INVENTOR(S) : Roy Lee Mast

It is certified that error appears in the above-identified patent and that said Letters Patent are hereby corrected as shown below:

Title page item [54],

Delete first occurrence of "MICROWAVE" in the title and replace with --MOISTURE-- so that the title of the patent is: "MOISTURE RETAINING PACKAGE FOR MICROWAVE COOKING."

Signed and Sealed this

Third Day of April, 2001

*Attest:*

Nicholas P. Godici

NICHOLAS P. GODICI

*Attesting Officer*

*Acting Director of the United States Patent and Trademark Office*